US009451792B1

(12) United States Patent
Alima

(10) Patent No.: US 9,451,792 B1
(45) Date of Patent: Sep. 27, 2016

(54) SYSTEMS AND METHODS FOR VAPORIZING ASSEMBLY

(71) Applicant: Yariv Alima, Plantation, FL (US)

(72) Inventor: Yariv Alima, Plantation, FL (US)

(73) Assignee: Atmos Nation, LLC, Davie, FL (US)

( * ) Notice: Subject to any disclaimer, the term of this patent is extended or adjusted under 35 U.S.C. 154(b) by 0 days.

(21) Appl. No.: 14/478,396

(22) Filed: Sep. 5, 2014

(51) Int. Cl.

| | |
|---|---|
| ***A24F 47/00*** | (2006.01) |
| ***H05B 1/02*** | (2006.01) |
| ***F22B 1/28*** | (2006.01) |
| ***A61L 9/03*** | (2006.01) |
| ***H05B 3/02*** | (2006.01) |

(52) U.S. Cl.
CPC ..... *A24F 47/008* (2013.01); *H05B 3/02* (2013.01)

(58) Field of Classification Search
CPC .... H05B 1/0202; H05B 1/0252; H05B 3/16; H05B 2203/022; H05B 2203/014; H05B 2203/021; H05B 3/02; A24F 47/008; F22B 1/284; F22B 1/28; F22B 1/287; A61L 9/03; B01D 1/0011
USPC ..... 392/386, 394, 396–398
See application file for complete search history.

(56) References Cited

U.S. PATENT DOCUMENTS 3,389,538 A * 6/1968 Carel ..... G01N 30/12 392/397
4,835,365 A * 5/1989 Etheridge ..... H05B 3/06 200/61.52
5,537,508 A * 7/1996 Ebbing ..... F22B 1/284 392/399
5,549,078 A * 8/1996 Annecharico ..... B01D 1/0017 122/32
5,930,458 A * 7/1999 Yane ..... F16L 55/115 392/482
7,533,719 B2 * 5/2009 Hinson ..... E21B 36/04 166/75.11
7,540,324 B2 * 6/2009 de Rouffignac ..... C10G 1/02 166/245
7,549,470 B2 * 6/2009 Vinegar ..... C10G 9/24 166/245
7,575,053 B2 * 8/2009 Vinegar ..... C07C 4/02 166/250.14
7,593,625 B2 * 9/2009 Kamikawa ..... F24H 1/101 392/393
7,640,980 B2 * 1/2010 Vinegar ..... E21B 36/02 166/268
7,735,935 B2 * 6/2010 Vinegar ..... E21B 43/243 166/272.1
7,798,220 B2 * 9/2010 Vinegar ..... E21B 36/04 166/272.1
7,798,221 B2 * 9/2010 Vinegar ..... C09K 8/592 166/272.1
7,831,133 B2 * 11/2010 Vinegar ..... C10L 3/08 166/302
7,866,386 B2 * 1/2011 Beer ..... E21B 43/24 166/258
8,151,907 B2 * 4/2012 MacDonald ..... C10G 21/22 175/26
8,220,539 B2 * 7/2012 Vinegar ..... E21B 43/2401 166/247
8,257,112 B2 * 9/2012 Tilley ..... H01R 4/70 439/586

(Continued)

*Primary Examiner* — Eric Stapleton

(57) ABSTRACT

An electric vaporizing chamber is provided as improved and versatile vaporization chamber for use with a vaporizing system. The electric vaporizing chamber provides an enclosure that contains the electric vaporizing chamber. The enclosure utilizes interfacing features for engaging a mouth piece or similar accessory as well as a battery unit or an alternative power source to the electric vaporizing chamber. Within the electric vaporizing chamber is a vaporizing chamber assembly that receives vaporizable material in an internally positioned compartment. The compartment is hard anodized improving heat transmission and facilitating clean up after use. The enclosure contains a plurality of ventilation ports that improve the drawing of vaporized material from the compartment and through a mouth piece or similar accessory. The electric vaporizing chamber is adequately insulated to prevent heat transmission to the enclosure.

12 Claims, 13 Drawing Sheets

(56) References Cited

U.S. PATENT DOCUMENTS 8,327,932 B2 * 12/2012 Karanikas ..... E21B 43/243 166/251.1
8,371,310 B2 * 2/2013 Brenneise ..... A24F 47/008 131/194
8,586,866 B2 * 11/2013 D'Angelo, III ..... E21B 17/003 174/74 R
8,627,887 B2 * 1/2014 Vinegar ..... B09C 1/02 166/272.1
8,943,686 B2 * 2/2015 Hartford ..... H01R 13/53 148/22
2008/0217321 A1 * 9/2008 Vinegar ..... C07C 4/02 219/492
2009/0025399 A1 * 1/2009 Kamen ..... B01D 1/02 62/6
2011/0120482 A1 * 5/2011 Brenneise ..... A24F 47/008 131/328
2013/0042865 A1 * 2/2013 Monsees ..... A61M 15/06 128/203.27
2013/0312742 A1 * 11/2013 Monsees ..... A61M 15/06 128/202.21
2014/0023352 A1 * 1/2014 Jurczyszak ..... H05B 1/0283 392/466
2015/0114409 A1 * 4/2015 Brammer ..... H05B 3/02 131/329
2015/0117841 A1 * 4/2015 Brammer ..... H05B 3/02 392/387
2015/0117842 A1 * 4/2015 Brammer ..... H05B 3/02 392/387

* cited by examiner

SYSTEMS AND METHODS FOR VAPORIZING ASSEMBLY

FIELD OF THE INVENTION

The present invention relates generally to a component of a vaporization device. More specifically to the electric vaporizing chamber that can be interfaced with a plurality of mouth pieces and battery units.

BACKGROUND OF THE INVENTION

Smoking is a widely practiced route of administration that involves the combustion of herbs in order to release active substances found in said herbs. The product of the combustion is then inhaled and absorbed through the lungs. Although many methods and mechanisms of smoking herbs currently exist, by far the most common is the cigarette. Cigarettes generally comprise a quantity of tobacco that is packed tightly into a cylindrical sealed rolling paper. One end of the cigarette is lit in order to combust the tobacco and release nicotine from the tobacco leaves. While tobacco cigarettes are most commonly smoked this way, many other loose herbs may be packed and rolled for consumption by smoking. Despite the prevalence of smoking, many health hazards and risks have become associated with the practice of consuming herbs by smoking. Modern medical studies have successfully linked a plethora of medical problems to smoking including many cancers, heart attacks/diseases, emphysema, infertility, and birth defects, among others. Many of these medical problems are caused by the toxic and carcinogenic products that are found in smoke. Several alternatives to rolling papers exist for smoking including pipes, hookahs, and bongs. However, the vast majority of these alternative methods of smoking still involve the combustion of herbs resulting in toxic and carcinogenic smoke. Vaporization is an alternative to burning that is generally regarded as a safer alternative, as a vaporizer extracts active ingredients form herbs without releasing the many toxins and carcinogens found in smoke. Although produced vapor still contains trace amounts of tar and noxious gases, the overall method is seen as a safer alternative to the full combustion of herbs. Despite the apparent lowered risk of vapor inhalation relative to smoke inhalation, a common practice is to alternate between the various methods of consuming herbs, often simply as a result of convenience. The present invention seeks to enhance and improve upon currently existing methods and accessories for consuming herbs.

It is therefore the object of the present invention to provide an improved and versatile electric vaporizing chamber for use with a vaporizing system. The electric vaporizing chamber provides an enclosure that contains the electric vaporizing chamber. The enclosure utilizes interfacing features for engaging a mouth piece or similar accessory as well as a battery unit or an alternative power source to the electric vaporizing chamber. Within the electric vaporizing chamber is a heating chamber assembly that receives vaporizable material in an internally positioned compartment. The compartment is hard anodized improving heat transmission and facilitating cleaning after use. The enclosure contains a plurality of ventilation ports that improve the drawing of vaporized material from the compartment and through a mouth piece or similar accessory. The electric vaporizing chamber is adequately insulated to prevent heat transmission to the enclosure.

BRIEF DESCRIPTIONS OF THE DRAWINGS

DETAIL DESCRIPTIONS OF THE INVENTION

All illustrations of the drawings are for the purpose of describing selected versions of the present invention and are not intended to limit the scope of the present invention.

Figure 1:
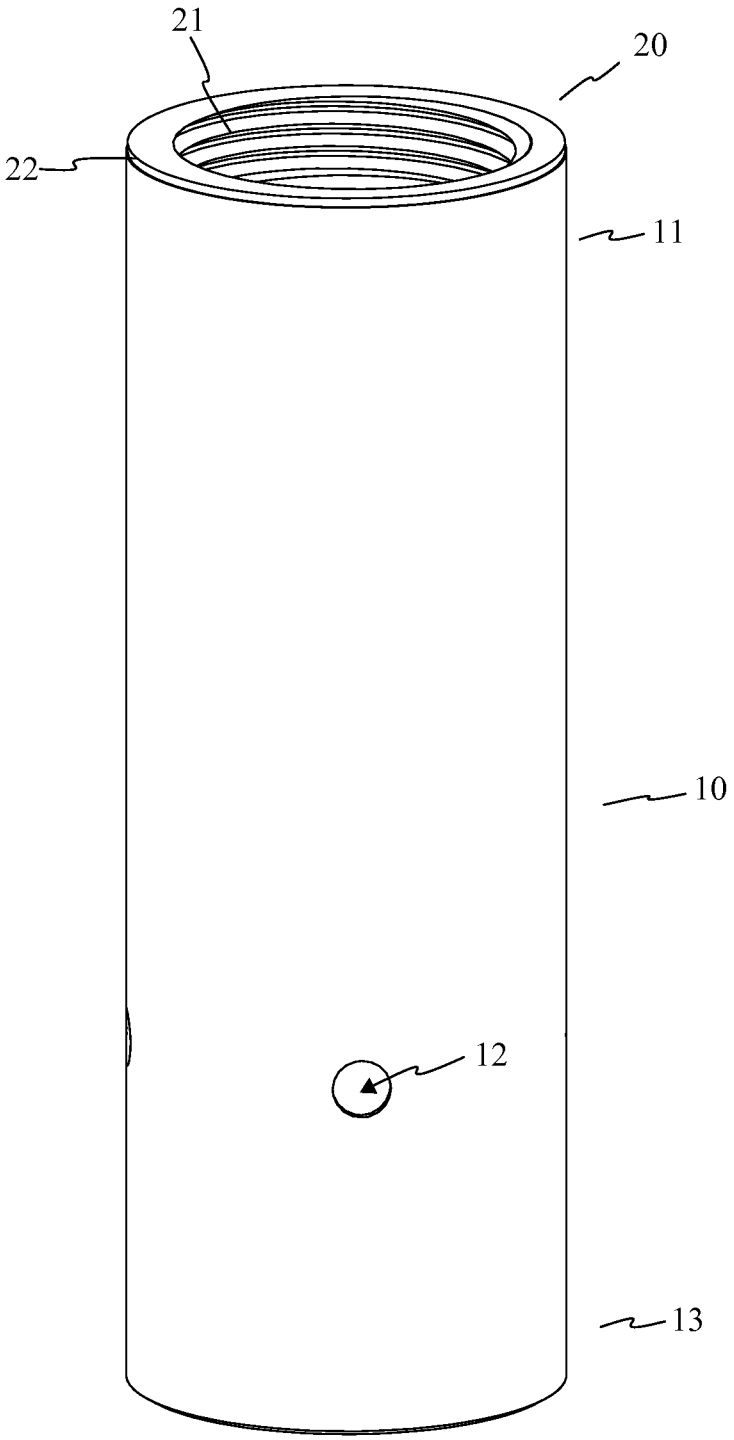
FIG. 1 is a perspective view displaying the exterior of the electric vaporizing chamber as per the current embodiment of the present invention.
Figure 2:
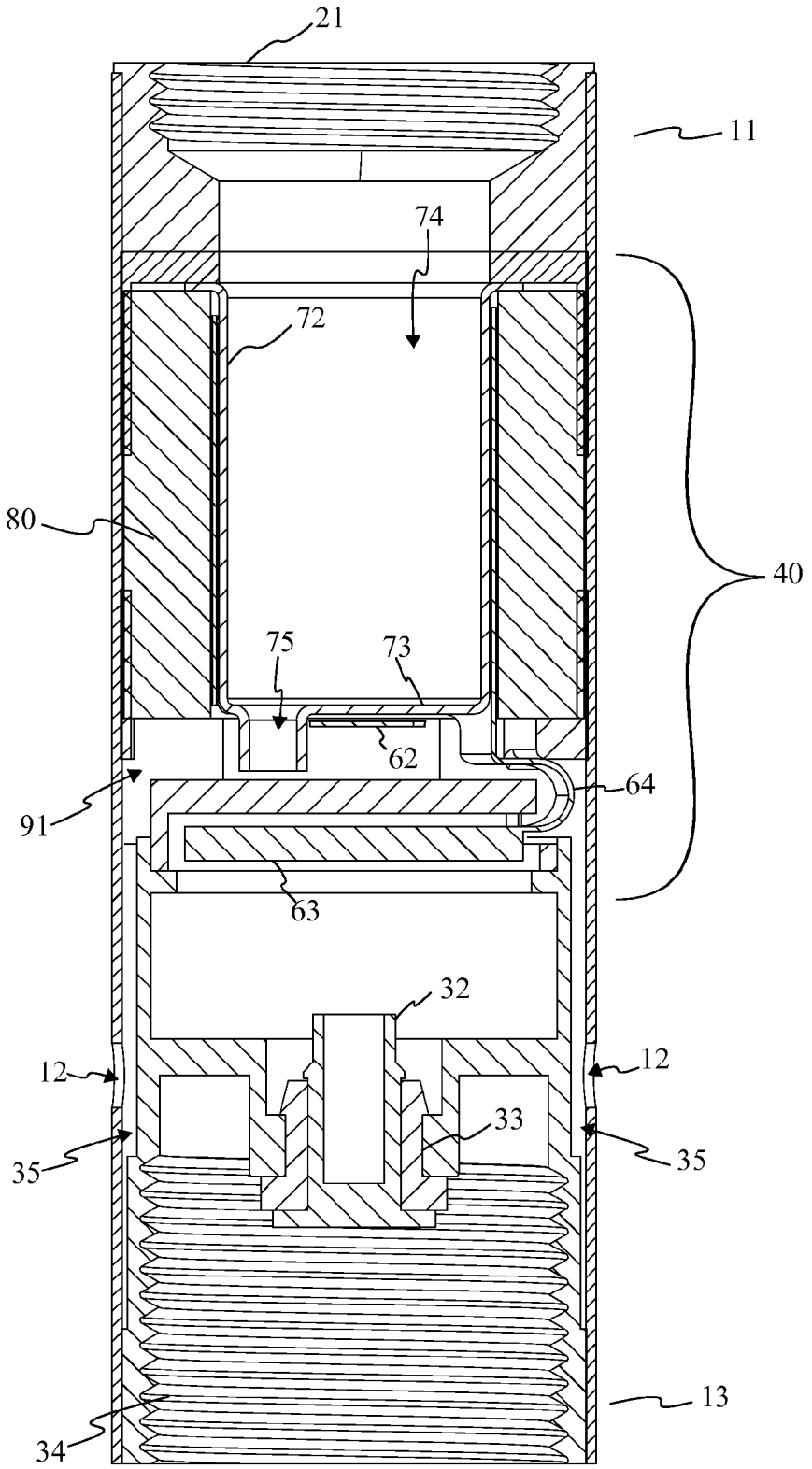
FIG. 2 is a sectional view displaying the internal component arrangement of the electric vaporizing chamber as per the current embodiment of the present invention.
Figure 3:
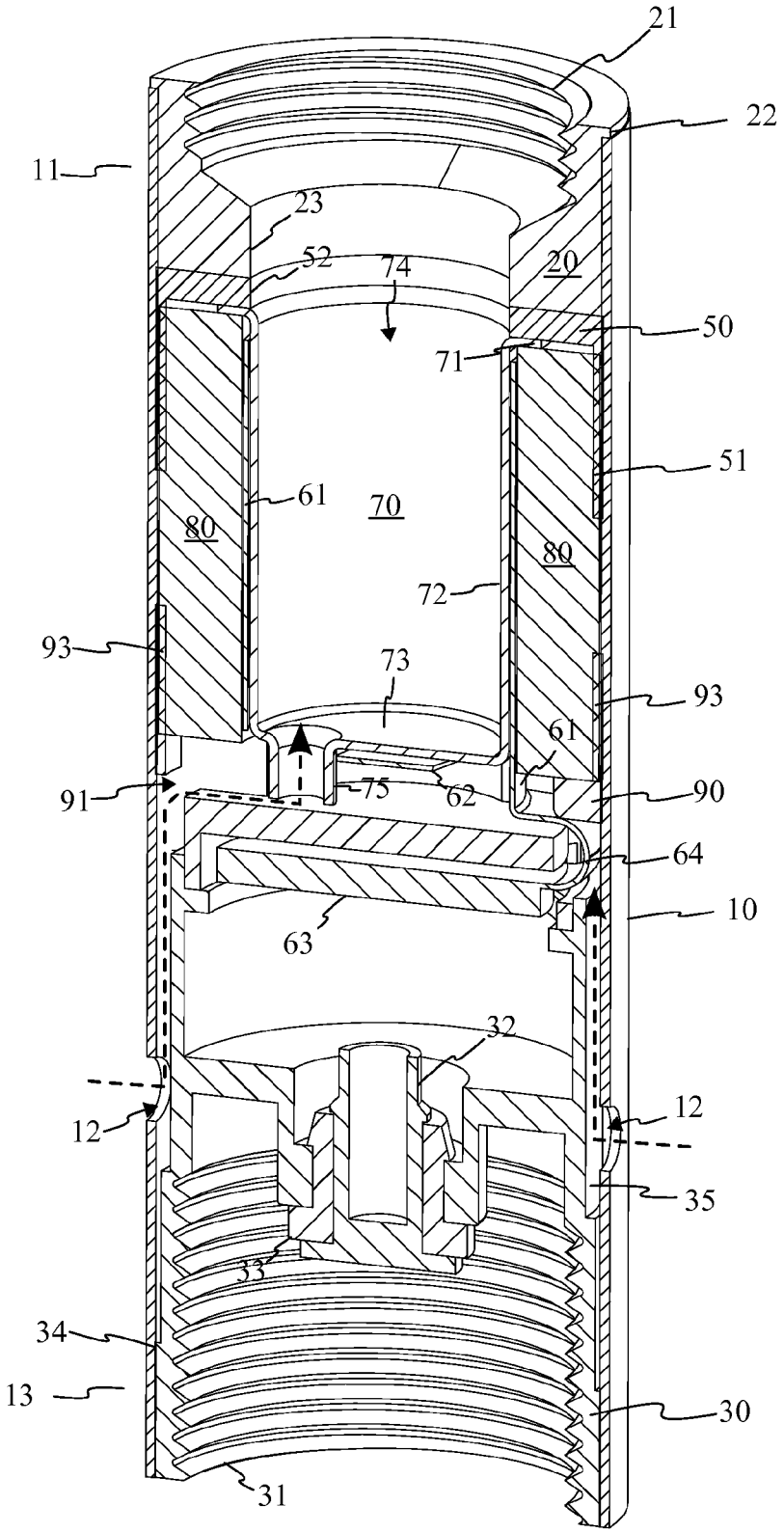
FIG. 3 is a perspective sectional view displaying the internal component arrangement and alignment of the ventilation ports, the perimeter gap, the air flow channel, and the air duct as per the current embodiment of the present invention.
Figure 4:
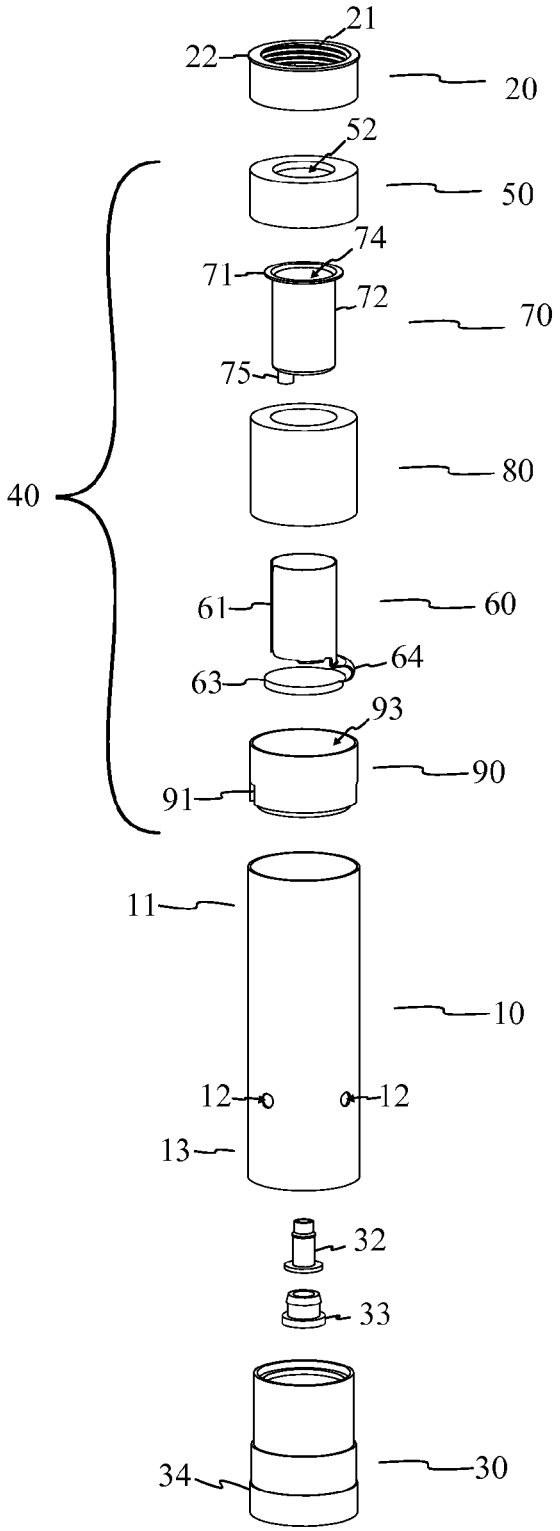
FIG. 4 is an expanded perspective view displaying the component alignment of the electric vaporizing chamber as per the current embodiment of the present invention.
Figure 5:
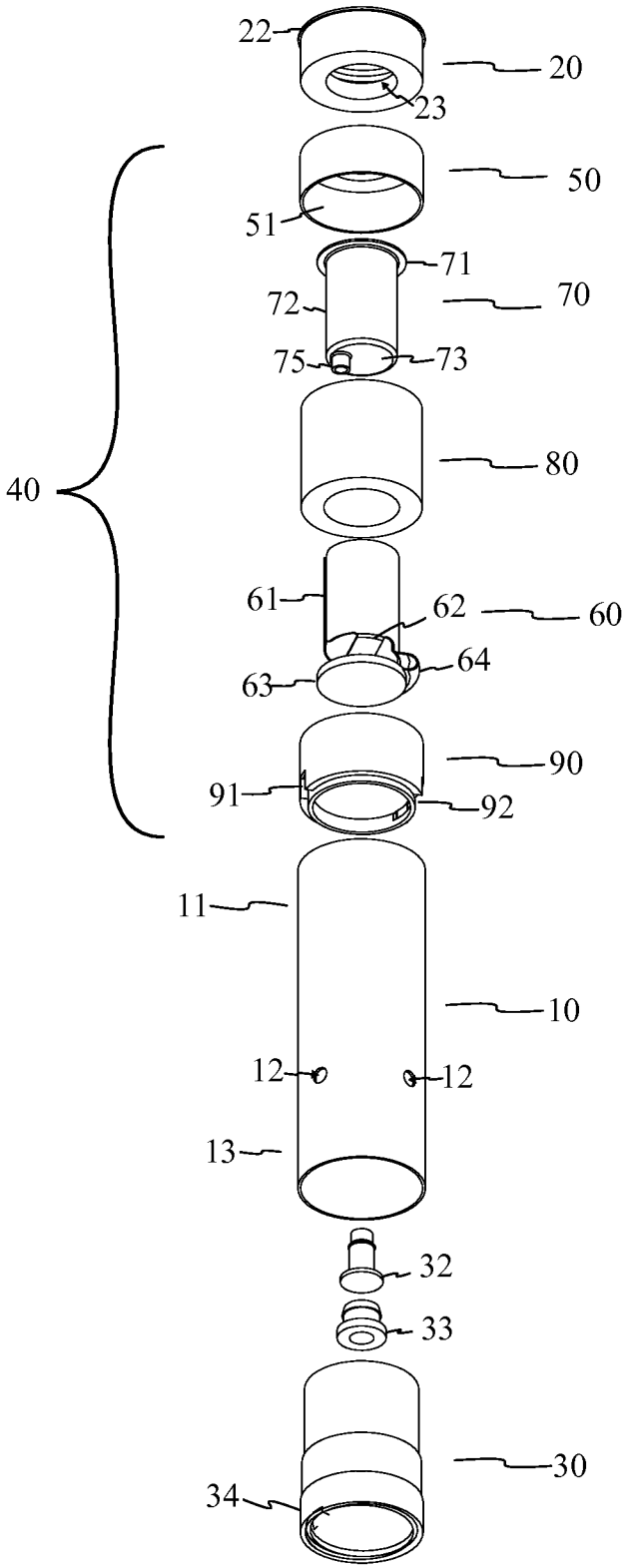
FIG. 5 is an expanded lower perspective view displaying the component alignment of the electric vaporizing chamber as per the current embodiment of the present invention.
Figure 6:
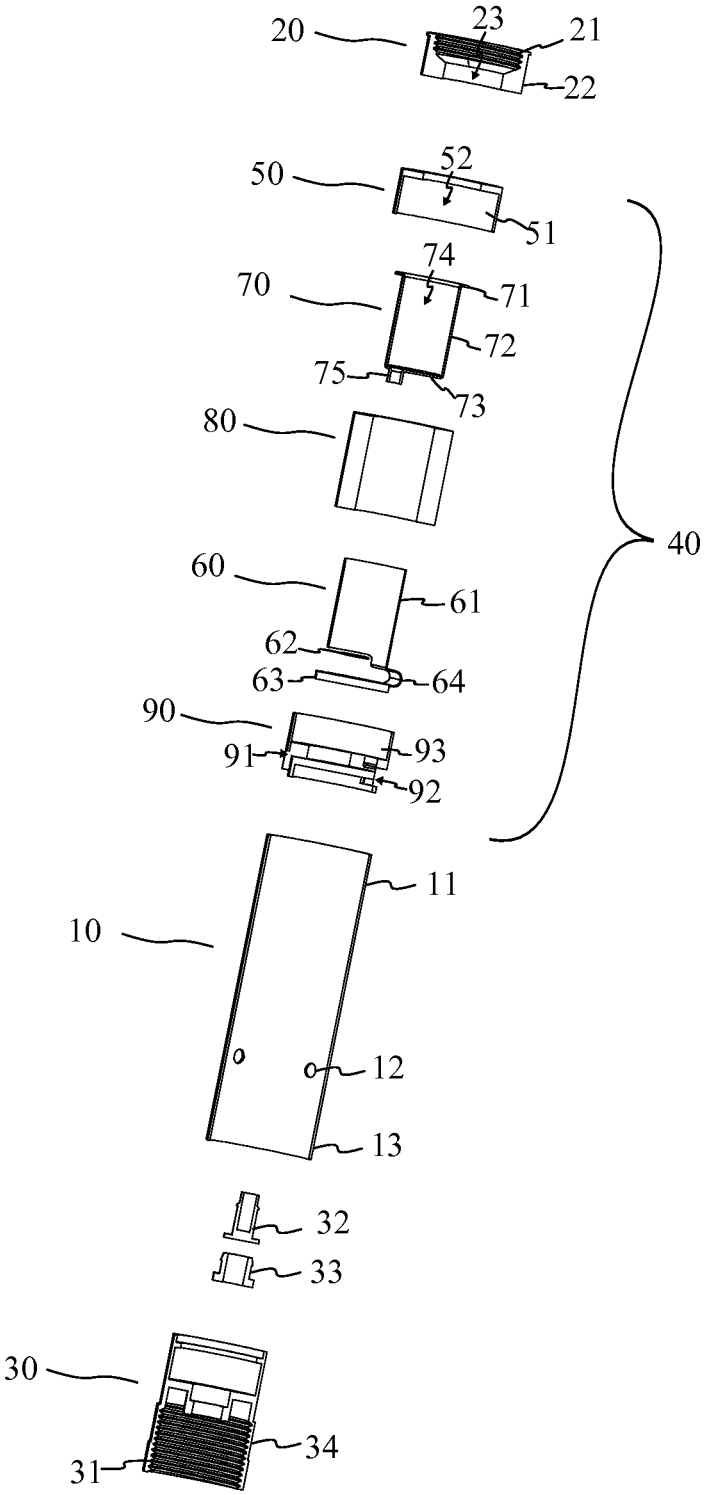
FIG. 6 is an expanded sectional view displaying the component positioning of the electric vaporizing chamber as per the current embodiment of the present invention.

Referencing FIG. 1-6, the present invention is an electric vaporizing chamber for use with an existing battery powered vaporizing system. The present invention facilitates cleaning, has improved energy consumption, and provides additional durability compared to existing electric vaporizing chambers. In the current embodiment of the present invention, the electric vaporizing chamber comprises a sleeve housing 10, an upper attachment feature 20, a lower attachment feature 30, and a vaporizing chamber assembly 40. The sleeve housing 10 functions as the exterior portion of the electric vaporizing chamber that encloses the vaporizing chamber assembly 40. The upper attachment feature 20 functions as an engagement point for mouth pieces and other accessories. The lower attachment feature 30 functions as the engagement point for a battery or an alternative power source.

Referencing FIG. 1-6, the electric vaporizing chamber is particularly configured to enable its functionality with existing vaporizing systems. In the current embodiment of the present invention, the sleeve housing 10, the upper attachment feature 20, the vaporizing chamber assembly 40, and the lower attachment feature 30 are all centrally aligned to one another. The central alignment ensures operative alignments between components of the present invention and additionally reduces the size of the present invention. The vaporizing chamber assembly 40 is enclosed to the upper attachment feature 20, the lower attachment feature 30, and the sleeve housing 10. The vaporizing chamber assembly 40 is positioned between the upper attachment feature 20 and the lower attachment feature 30. The upper attachment feature 20 is terminally engaged to the sleeve housing 10 opposite the lower attachment feature 30, wherein the terminal engagement provides the upper attachment feature 20 and the lower attachment feature 30 being positioned at opposite ends of the sleeve housing 10. The lower engagement feature is electrical coupled to the vaporizing chamber assembly 40 enabling the vaporizing chamber assembly 40 to function. The sleeve housing 10 peripherally surrounds the vaporizing chamber assembly 40 forming a protective cover. The sleeve housing 10 comprises a plurality of ventilation ports 12 that permit fluid communication with the vaporizing chamber assembly 40.

Referencing FIG. 1-6, the sleeve housing 10 is provided as the exterior cover of the present invention. The housing sleeve is cylindrical in shape and extends a distance sufficient to enclose the vaporizing chamber assembly 40, the upper attachment feature 20, and the lower attachment feature 30. The sleeve housing 10 serves as a mounting point for the upper attachment feature 20 and the lower attachment feature 30. The upper attachment feature 20 is terminally mounted to the sleeve housing 10 opposite the lower attachment feature 30. The positioning of the upper attachment feature 20 and the lower attachment feature 30 enables the enclosed positioning of the vaporizing chamber assembly 40 within the sleeve housing 10. In the current embodiment of the present invention, the sleeve housing 10 comprises a first end 11, a second end 13, and a plurality of ventilation ports 12. The first end 11 and the second end 13 are opposing regions of the sleeve housing 10. The first end 11 is coincident with the upper attachment feature 20. The first end 11 of the sleeve housing 10 partially surrounds the upper attachment feature 20. The upper attachment feature 20 is mounted to the first end 11 of sleeve housing 10 by way of a first housing mount 22. The second end 13 is coincident with the lower attachment feature 30. The second end 13 of the sleeve housing 10 partially surrounds the lower attachment feature 30. The lower attachment feature 30 is mounted to the second end 13 of the sleeve housing 10 by way of the second housing mount 34. The plurality of ventilation ports 12 provide a conduit for air to interact with the vaporizing chamber assembly 40. The plurality of ventilation ports 12 traverse the exterior of the sleeve housing 10. The plurality of ventilation ports 12 are perimetrically positioned around the sleeve housing 10 between the first end 11 and the second end 13. The positioning of the plurality of ventilation ports 12 provides a coincident arrangement with fluid transport elements of the vaporizing chamber assembly 40 and lower attachment feature 30.

Figure 8:
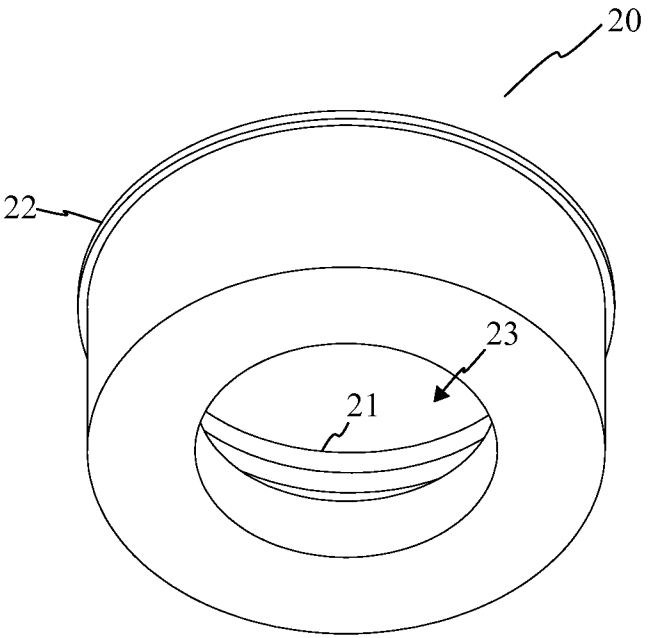
FIG. 8 is a bottom perspective view of the upper attachment feature.
Figure 7:
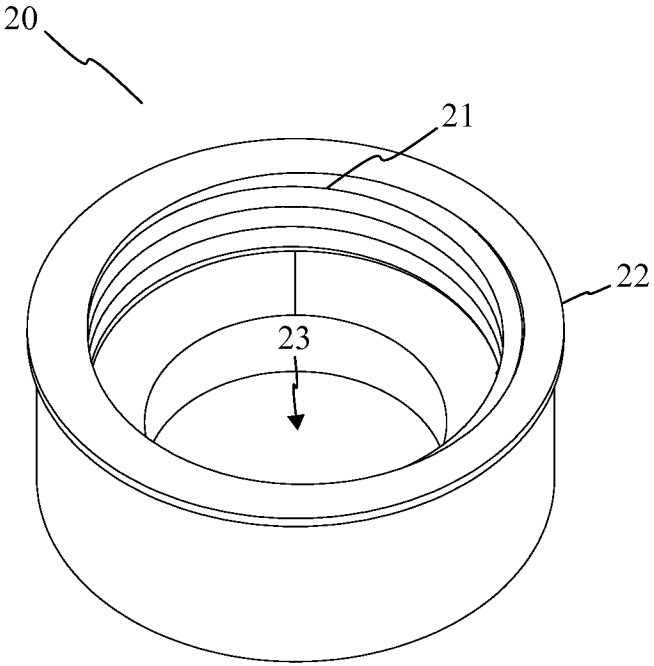
FIG. 7 is a top perspective view of the upper attachment feature.

Referencing FIG. 1-6, FIG. 7, and FIG. 8, the upper attachment feature 20 provides an attachable interface for a vaporization mouth piece or similar accessory. The upper attachment feature 20 is terminally positioned on the sleeve housing 10 opposite the lower attachment feature 30. The upper attachment feature 20 is partially surrounded by the first end 11 of the sleeve housing 10. The upper attachment feature 20 is coincident with the upper portion of the vaporizing chamber assembly 40. In the current embodiment of the present invention, the upper attachment feature 20 comprises an attachment mount 21, a first housing mount 22, and a first chamber passage 23. The attachment mount 21 is the interfacing feature that enables the attachment of mouth piece or similar accessory. The first housing mount 22 is an engageable feature that facilitates the secure engagement of the upper attachment feature 20 to the first end 11 of the sleeve housing 10. The first housing mount 22 is provided with a rim that retains the upper attachment feature 20 in place when secured to the sleeve housing 10. The first chamber passage 23 is a centrally positioned voided space that aligns with similar features of the vaporizing chamber assembly 40 to facilitate the introduction of vaporizable material into the vaporizing chamber assembly 40 as well as the removal of vapor from the vaporizing chamber assembly 40. The attachment mount 21 is centrally positioned to the first housing mount 22. The first chamber passage 23 centrally traverses the attachment mount 21. The positioning of the first chamber passage 23 relative to the attachment provides the attachment of the mouth piece or similar accessory to align with the first chamber passage 23.

Figure 17:
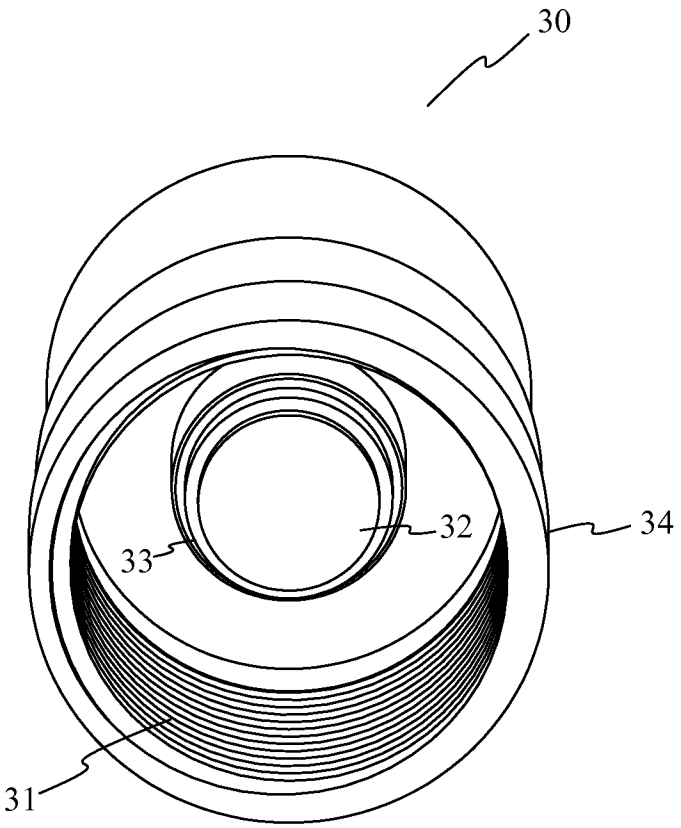
FIG. 17 is a bottom perspective view of the lower attachment feature.
Figure 16:
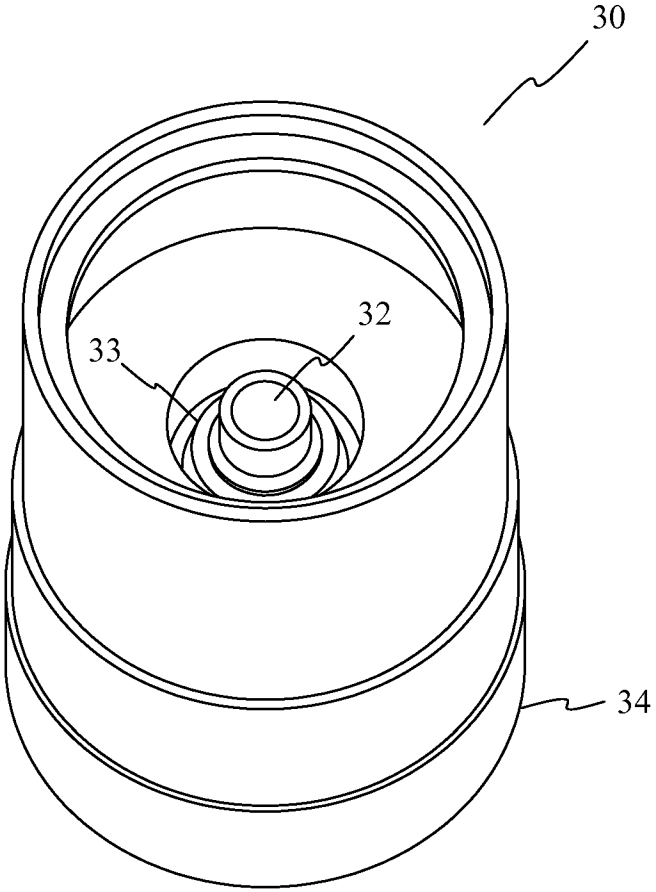
FIG. 16 is a top perspective view of the lower attachment feature.

Referencing FIG. 1-6, FIG. 16, and FIG. 17, the lower attachment feature 30 is provided as the interfacing component for engaging with a battery unit of an existing vaporization system or an alternative power source. The lower attachment feature 30 is positioned opposite the upper attachment feature 20 across sleeve housing 10. The lower attachment feature 30 is partially surrounded by the second end 13 of the sleeve housing 10. The lower attachment feature 30 is found coincident with the lower portion of the vaporizing chamber assembly 40. In the current embodiment of the present invention, the lower attachment feature 30 comprises a battery mount 31, a contact pin 32, a pin mount 33, a second housing mount 34, and perimeter gaps 35. The battery mount 31 is the interfacing featuring that allows the attachment of a battery unit or an alternative power source. The pin mount 33 is the contacting element that is electrically coupled to the terminal element of a mounted battery unit or alternative power source. The contact pin 32 is the adjustable feature that engages the conducting features of the heating element 60. The contact pin 32 is positioned coincident with the pin mount 33. The second housing mount 34 is an engageable feature peripherally positioned to the battery mount 31 that engages the second end 13 of the sleeve housing 10. The perimeter gap 35 is a voided space formed by a recessed region of the lower attachment feature 30 and the sleeve housing 10 that functions as a fluid conduit for the passage of air from the plurality of ventilation ports 12 to the vaporizing chamber assembly 40. The battery mount 31 is centrally positioned to the second housing mount 34. The positioning of the battery mount 31 ensures a central alignment with an attached battery unit or alternative power source. The pin mount 33 is centrally positioned to the battery mount 31. The pin mount 33 being recessed within the battery mount 31. The contact pin 32 is adjustably positioned to the pin mount 33. The adjustable positioning permits the contact pin 32 to engage conductive elements of the vaporizing chamber assembly 40 when a battery unit or alternative power source is attached to the lower attachment feature 30. The contact pin 32 is in electrical communication with the battery mount 31 by way of the pin mount 33. An attached battery unit or alternative power source electrically engages the pin mount 33 which is electrically coupled with the contact pin 32. The contact pin 32 is coincidentally aligned with conductive elements of the vaporizing chamber assembly 40.

Referencing FIG. 1-6, the vaporizing chamber assembly 40 allows for the formation of vapor from vaporizable material positioned within the assembly. The vaporizing chamber assembly 40 is positioned between upper attachment feature 20 and the lower attachment feature 30. The vaporizing chamber assembly 40 is surrounded by the sleeve housing 10. The arrangement of the upper attachment feature 20, the lower attachment feature 30, and the sleeve housing 10 encloses the vaporizing chamber assembly 40 within the present invention. In the current embodiment of the present invention, the vaporizing chamber assembly 40 comprises an assembly cap 50, a heating element 60, a heating chamber 70, an insulator 80, and an assembly seat 90. The assembly cap 50 is the upper portion of the vaporizing chamber assembly 40 that is coincident with the upper attachment feature 20. The assembly cap 50 and the assembly seat 90 function cooperatively to retain positioning of the heating chamber 70, the heating element 60, and the insulator 80. The heating chamber 70 receives vaporizable material that is heated until a vapor is formed. The heating element 60 is the component that heats the heating chamber 70 in order to vaporize the material positioned within the heating chamber 70. The insulator 80 is perimetrically positioned around the insulator surrounding the heating element 60 and the heating chamber 70. The insulator 60 prevents heat from dissipating to the sleeve housing 10.

Figure 10:
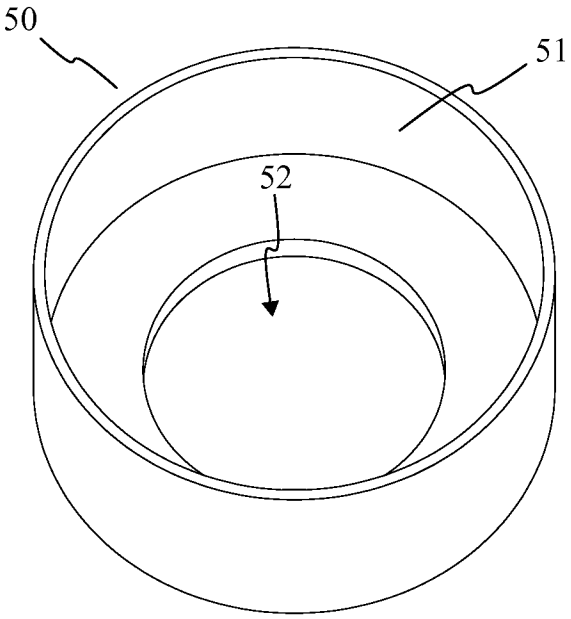
FIG. 10 is a bottom perspective view of the assembly cap.
Figure 9:
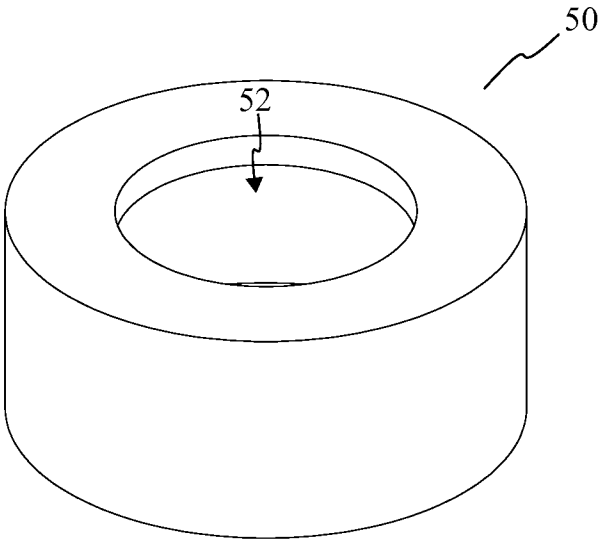
FIG. 9 is a top perspective view of the assembly cap.

Referencing FIG. 1-6, FIG. 9, and FIG. 10, the assembly cap 50 is the upper portion of the vaporizing chamber assembly 40. The assembly cap 50 is found coincident with the upper attachment feature 20. The assembly cap 50 sleeves the insulator 80. The insulator 80 turns surrounds both the heating chamber 70 and the heating element 60. The arrangement between the assembly cap 50 and the insulator 80 ensures a central alignment for the heating chamber 70 and the heating element 60. The assembly cap 50 is coincident with the heating chamber 70 by way of a lip 71 feature that protrudes from the edge of the heating chamber 70. The lip 71 of the heating chamber 70 becomes secured between the assembly cap 50 and the insulator 80. In the current embodiment of the present invention, the assembly cap 50 comprises an insulator cover 51 and a second chamber passage 52. The insulator cover 51 is a recessed feature that partially sleeves the insulator 80. The second chamber passage 52 is centrally positioned to the insulator cover 51. The second chamber passage 52 is the centrally positioned voided space that aligns with the first chamber passage 23 of the upper attachment feature 20. The second chamber passage's 52 alignment with the first chamber passage 23 provides an avenue for introducing vaporizable material into the heating chamber 70 or removing vapor from the heating chamber 70.

Figure 15:
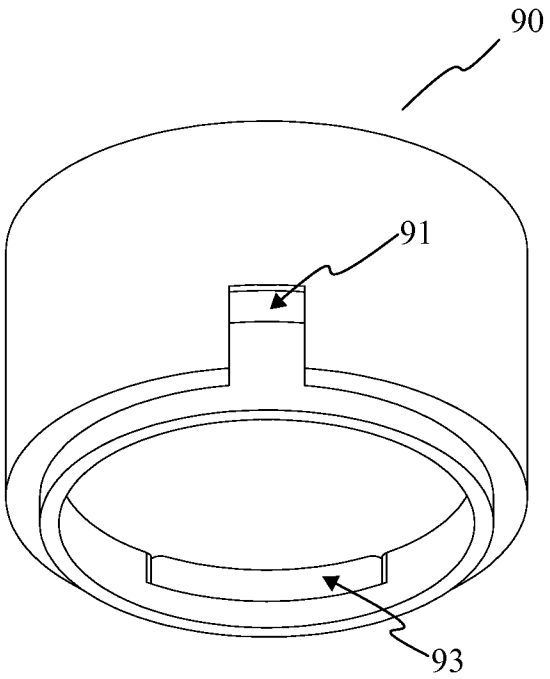
FIG. 15 is a bottom perspective view of the assembly seat.
Figure 14:
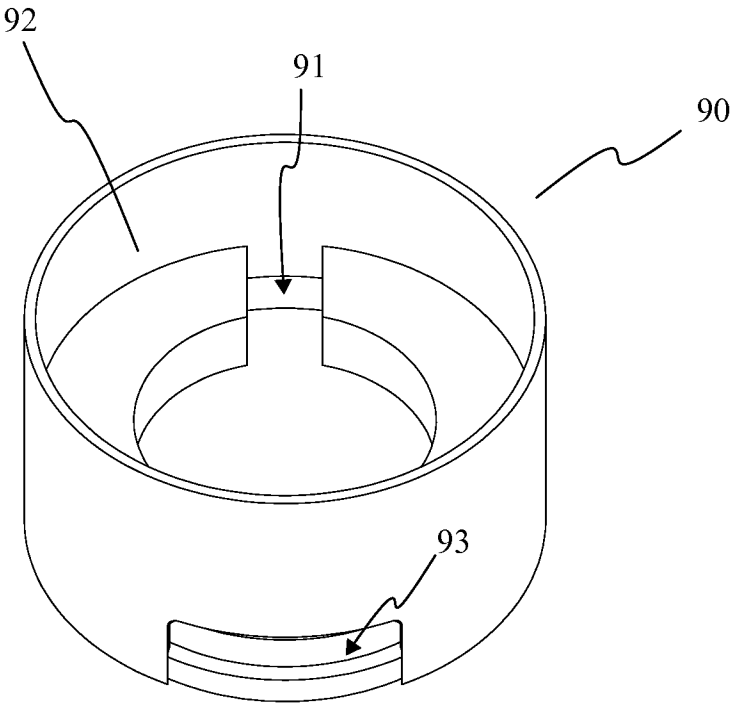
FIG. 14 is a top perspective view of the assembly seat.

Referencing FIG. 1-6, FIG. 14, and FIG. 15, the assembly seat 90 is an opposing feature to the assembly cap 50. The assembly seat 90 is provided as the lower mounting point for the insulator 80 and the heating element 60. The assembly seat 90 is found coincident with the upper surface of the lower attachment feature 30. In the current embodiment of the present invention, the assembly seat 90 comprises an air flow channel 91, a connector emplacement 92, and an insulator mount 93. The insulator mount 93 is a recessed feature that provides a coincident mounting point for the insulator 80 opposite the insulator cover 51. The air flow channel 91 is an excised region of the assembly seat 90 that is found on the periphery of the insulator mount 93. The air flow channel 91 is provided as the fluid passage for permitting air flow from the perimeter gap 35 towards the heating chamber 70. The airflow channel is positioned opposite the connector emplacement 92 across the insulator mount 93. The connector emplacement 92 is provided as a feature that becomes coincident with a flexible connector 64 of the heating element 60. The connector emplacement 92 secures the heating element 60 in a particular arrangement relative to the heating chamber 70 and the contact pin 32 of the lower attachment feature 30.

Figure 12:
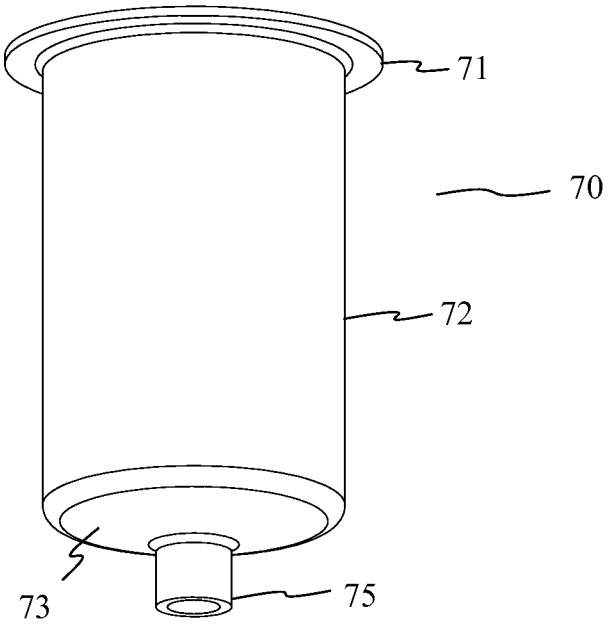
FIG. 12 is a bottom perspective view of the heating chamber.
Figure 11:
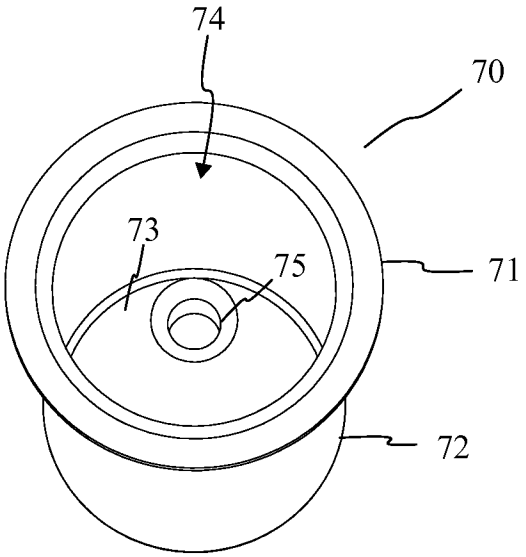
FIG. 11 is a top perspective view of the heating chamber.

Referencing FIG. 1-6, FIG. 11, and FIG. 12, the heating chamber 70 is the container in which material is vaporized in. the heating chamber 70 is centrally positioned relative to the heating element 60 and the insulator 80. The heating chamber 70 is thermally conductive and is found coincident with the heating element 60. The heating chamber 70 is constructed of a hard anodized material that improves heat transmission and facilitates cleaning of the heating chamber 70. In the current embodiment of the present invention, the heating chamber 70 comprises a lip 71, a lateral wall 72, a lower plate, a compartment 74, and an air duct 75. The lip 71 is a protrusion from the lateral wall 72 that functions as an engageable feature for securing the heating chamber 70 in a particular position. The lateral wall 72 is the revolved exterior surface of the heating chamber 70 that is in contact with the heating element 60. The lower plate is coincident with the lateral wall 72 and functions as the lower surface of the heating chamber 70. Similar to the lateral wall 72, the lower plate is also coincident with the heating element 60. The lower plate and the lateral wall 72 form the compartment 74. The compartment 74 is formed by the lower plate and the lateral wall 72 and serves as the receiving space for vaporizable material. The compartment 74 is aligned with the second chamber passage 52 and the first chamber passage 23. The air duct 75 is a protrusion extending from the lower plate opposite the compartment 74. The air duct 75 provides an air passage between the compartment 74 and the perimeter gap 35 facilitating the flow of air from the plurality of ventilation ports 12 through the air flow channel 91 and into the compartment 74. The air duct 75 is positioned adjacent to the portion of the heating element 60 contacting the lower plate.

Figure 13:
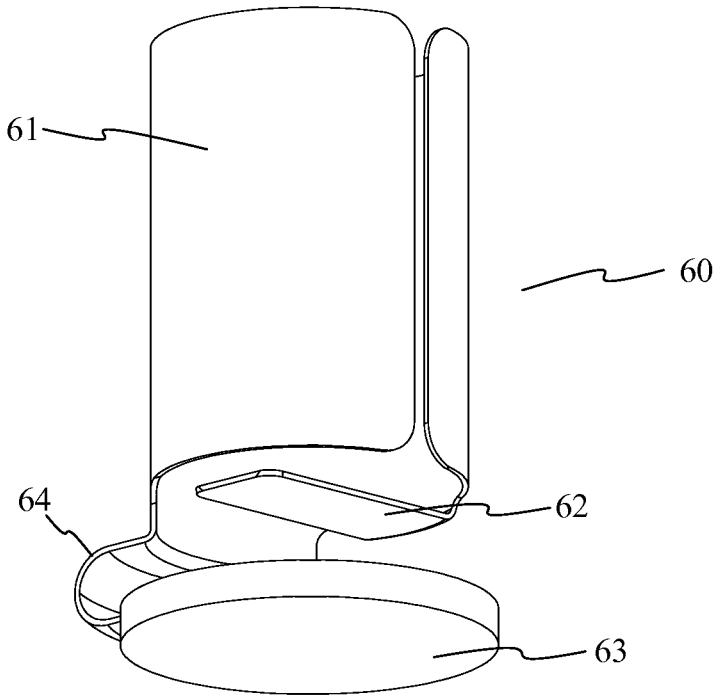
FIG. 13 is a perspective view of the heating element.

Referencing FIG. 1-6, and FIG. 13, the heating element 60 is a conductive element that is thermally conductive and electrically resistive. The heating element 60 is particularly engages the lateral wall 72 and the lower plate of the heating chamber 70 in order to effectively transfer heat to vaporize the contents of the compartment 74. The heating element 60 is electrically coincident with the contact pin 32 of lower attachment feature 30. When an attached battery unit or alternative power source is coupled to the battery mount 31, the pin mount 33 becomes engaged and the contact pin 32 rise to engage the contact point of the heating element 60. The pin mount 33 and the contact pin 32 are provided as being electrically conductive and provide current to the contacting surface of the heating element 60. In the current embodiment of the present invention, the heating element 60 comprises a chamber sleeve 61, a chamber seat 62, a temperature control assembly 63, and a flexible connector 64. The chamber sleeve 61 is the portion of the heating element 60 that surrounds the lateral wall 72 of the heating chamber 70. The chamber seat 62 is a protrusion of the heating element 60 that contacts the lower plate adjacent to the air duct 75. The temperature control assembly 63 is positioned opposite the chamber sleeve 61 and the chamber seat 62 across the assembly seat 90. The temperature control assembly 63 and regulates the heat generated by the heating element 60. The temperature control assembly 63 houses a temperature sensor and temperature control electronics that regulate the heat generated by the chamber sleeve 61 and the chamber seat 62, resulting in a more consistent vaporization. The flexible connector 64 is coincidentally positioned in the connector emplacement 92. The flexible connector 64 couples the temperature control assembly 63 to the chamber sleeve 61 and the chamber seat 62. The temperature control assembly 63, the chamber sleeve 61, and the contact pin 32 are connected via the flexible connector 64 in a parallel connection, in an embodiment. The chamber sleeve 61 and the chamber plate are resistive to current as a result generates heat. The heat generated by the chamber sleeve 61 and the chamber plate is transferred to the heating chamber 70.

Figure 18:
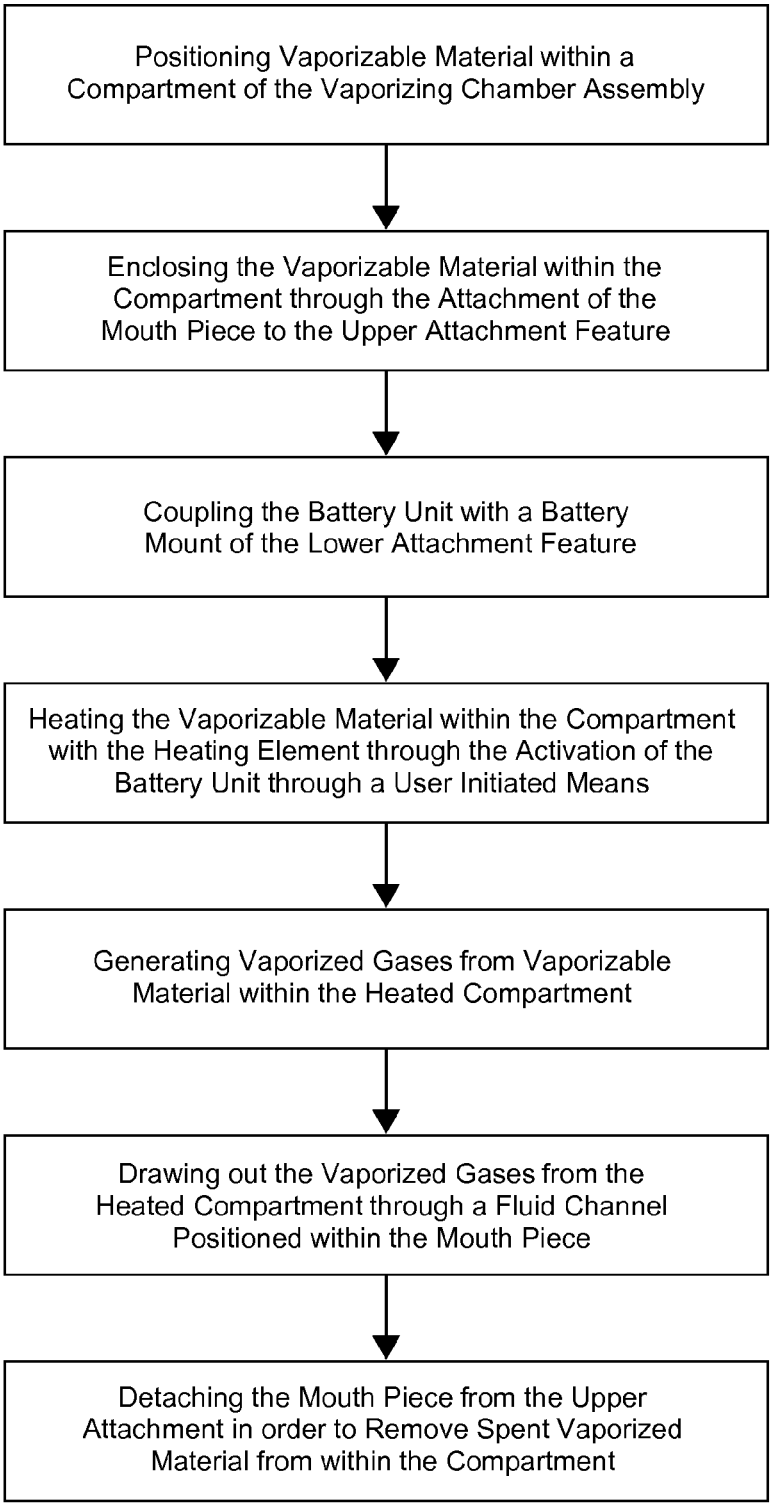
FIG. 18 is a flow chart diagram displaying a general overview of the method of use for the present invention.

Referencing FIG. 1-6 and FIG. 18, in the current embodiment of the present invention, a user would initiate operation of the electric vaporizing chamber by placing vaporizable material within the compartment 74 of the heating chamber 70. The user would introduce the vaporizable material through the first chamber passage 23 and the second chamber passage 52. It should be noted that the vaporizable materials include but are not limited to herbs, oils, and waxes as well as any combinations thereof. Following the introduction of the vaporizable material into the compartment 74 the user would attach a mouth piece or a similar device to draw formed vapor from the heating chamber. The mouth piece is particularly formed to engage the attachment mount 21 of the upper attachment feature 20. The attachment of the mouth piece aligns the first chamber passage 23 with a channel within the mouth piece. With the mouth piece engaged to the attachment mount 21, air flow to the compartment 74 would be restricted reducing combustion of the vaporizable material.

Referencing FIG. 1-6 and FIG. 18, with the mouth piece attached to the electric vaporizing chamber, a battery unit or an alternative power source would be attached to the lower attachment feature 30. The battery unit comprises particular features that enable attachment to the battery mount 31 of the lower attachment feature 30. It should be noted that the current embodiment of the present invention uses a threaded engagement to secure the battery unit to the battery mount 31, but any attachment means could potentially be used to accomplish the same functionality. Upon attaching the battery unit to the battery mount 31, an electrical contact of the battery unit would become coincidently aligned with bottom portion of the contact pin 32, wherein the coincident alignment enables an electrical engagement between the electrical contact of the battery unit and the electrically powered components of the electric vaporizing chamber. The contact pin 32 is moveably positioned to the pin mount 33. The resulting engagement of the contact pin 32 with the electrical contact of the battery unit would allow the contact pin 32 to rise upwardly from the pin mount 33 towards the temperature control assembly 63 of the heating element 60. With the battery unit secured, the user would activate the battery unit through a user initiated means providing current to the present invention. It should be noted that the user initiated means for activating the battery can be accomplished depressing a button on the battery unit or through the incorporation of a pressure sensing actuator that detects negative pressure as a result of the user drawing from the mouth piece and activates the battery unit. Furthermore it should be noted that additional means of activating the battery unit could potentially be utilized in future embodiments.

Referencing FIG. 1-6 and FIG. 18, the pin mount 33 and the contact pin 32 being electrically conductive, would transfer power from the battery unit to the heating element 60 by way of the temperature control assembly 63. The temperature control assembly 63 and the flexible connector 64 of the heating element 60 are electrically conductive, but the chamber sleeve 61 and the chamber seat 62 are configured to be electrically resistive. As a result of the resistive configuration, the chamber seat 62 and the chamber sleeve 61 generate heat upon receiving an electric current. The heat generated by the chamber sleeve 61 and the chamber seat 62 is transferred to the heating chamber 70. The heating chamber 70 is hard anodized permitting it to be highly conductive to heat. With heat applied to the heating chamber 70 and the mouth piece attached reducing passive air flow to the compartment 74, the vaporizable material within the compartment 74 reaches temperatures surpassing the material's combustion point reaching its vaporization point. At the vaporization point, the vaporizable compounds of the vaporizable material undergo a phase change into a gaseous form that fills the compartment 74. The vaporized gases are drawn out of the compartment 74 through the mouth piece. The vaporized gases are able to be drawn out of the compartment 74 by air flow facilitated by fluid communication between the heating chamber 70 and the plurality of ventilation ports 12 positioned parametrically around the sleeve housing 10. The plurality of ports 12 are in fluid communication with a perimeter gap 35 formed between the lower attachment feature 30 and the sleeve housing 10. The perimeter gap 35 is in fluid communication with the air flow channel 91 of the assembly seat 90. The air flow channel 91 direct air flow from the perimeter gap 35 towards the air duct 75 of the heating chamber 70. The air duct 75 is the main passage through which air flows into the compartment 74 allowing a user to draw the vapor through the mouth piece.

Referencing FIG. 1-6 and FIG. 18, after the vaporizable material has been spent, the user would detach the battery unit from the lower attachment feature 30. The user would then detach the mouth piece from the upper attachment feature 20. With the compartment 74 exposed, the user would be able to clear the spent vaporized material from the compartment 74. The hard anodized coating on the compartment 74 prevents the material from sticking to the lateral walls 72 and additionally facilitates cleaning of the present invention.

Although the invention has been explained in relation to its preferred embodiment, it is to be understood that many other possible modifications and variations can be made without departing from the spirit and scope of the invention as hereinafter claimed.

What is claimed is:

1. A electric vaporizing chamber comprises:

a sleeve housing;

an upper attachment feature;

a lower attachment feature;

a vaporizing chamber assembly;

the sleeve housing comprises a first end, a second end, and a plurality of ventilation ports;

the upper attachment feature comprises an attachment mount, a first housing mount, and a first chamber passage;

the lower attachment feature comprises a battery mount, pin mount, a contact pin, a second housing mount, and perimeter gap;

the vaporizing chamber assembly comprises an assembly cap, a heating element, a heating chamber, an insulator, and an assembly seat;

the assembly cap comprises an insulator cover and a second chamber passage;

the heating element comprises a chamber sleeve, a chamber seat, a temperature control assembly, and a flexible connector;

the heating chamber comprises a lip, a lateral wall, a lower plate, a compartment, and an air duct;

the assembly seat comprises air flow channels, a connector emplacement, and an insulator mount;

the sleeve housing, the upper attachment feature, the lower attachment feature, and the vaporizing chamber assembly being centrally aligned to one another;

the vaporizing chamber assembly being enclosed by the upper attachment feature, the lower attachment feature and the sleeve housing;

the vaporizing chamber assembly being positioned between the upper attachment feature and the lower attachment feature;

the upper attachment feature being terminally positioned on the sleeve housing;

the lower attachment feature being terminally positioned on the sleeve housing, opposite the upper attachment feature;

the lower attachment feature being electrically coupled with the vaporizing chamber assembly; and the sleeve housing being in fluid communication with the vaporizing chamber assembly.

2. The electric vaporizing chamber as claimed in claim 1 comprises:

the upper attachment feature being partially surrounded by the sleeve housing;

the upper attachment feature being coupled to the first end of the sleeve housing by way of the first housing mount;

the upper attachment feature being coincident with assembly cap opposite the heating chamber and the insulator;

the attachment mount being centrally positioned to the first housing mount; and the first chamber passage centrally traverse the attachment mount.

3. The electric vaporizing chamber as claimed in claim 1 comprises:

the lower attachment feature being partially surrounded by the sleeve housing;

the lower attachment feature being coincident with the assembly seat opposite the heating chamber;

the lower attachment feature being coupled to the second end of the sleeve housing by way of the second housing mount;

the perimeter gap being surrounded by the housing sleeve;

the battery mount being centrally positioned to the second housing mount;

the pin mount being recessed within the battery mount;

the pin mount being centrally positioned to the battery mount;

the contact pin being adjustably positioned to the pin mount;

the contact pin being coincidently aligned with the temperature control assembly of the heating element; and the contact pin being in electrical communication with the battery mount by way of the pin mount.

4. The electric vaporizing chamber as claimed in claim 1 comprises:

the second chamber passage being centrally positioned to the insulator cover;

the second chamber passage being aligned with the first chamber passage;

the insulator being secured between the assembly cap and the assembly seat;

the insulator being partially sleeved by the insulator cover;

the insulator being positioned against the insulator mount; and the insulator being perimetrically positioned around the chamber sleeve of the heating element.

5. The electric vaporizing chamber as claimed in claim 1 comprises:

the lip being securely positioned between the insulator and the assembly cap;

the lateral wall being peripherally surrounded by the chamber sleeve;

the compartment being formed by the lateral wall and the lower plate;

the compartment being operatively aligned with the second chamber passage;

the air duct being positioned on the lower plate opposite the compartment; and the chamber seat being positioned against the lower plate adjacent to the air duct.

6. The electric vaporizing chamber as claimed in claim 1 comprises:

the air flow channel being positioned opposite the connector emplacement across the insulator mount;

the temperature control assembly being positioned opposite the insulator mount;

the temperature control assembly being electrically coupled to the chamber sleeve and the chamber seat by way of the flexible connector; and the flexible connector being coincidently positioned with the connector emplacement.

7. The electric vaporizing chamber as claimed in claim 1 comprises:

the plurality of ventilation ports being perimetrically positioned between the first end and the second end;

the plurality of ventilation ports being coincidently aligned with the perimeter gap; and the air duct being in fluid communication with the perimeter gap by way of the air flow channel.

8. An electric vaporizing chamber comprises:

a sleeve housing;

an upper attachment feature;

a lower attachment feature;

a vaporizing chamber assembly;

the sleeve housing comprises a first end, a second end, and a plurality of ventilation ports;

the upper attachment feature comprises an attachment mount, a first housing mount, and a first chamber passage;

the lower attachment feature comprises a battery mount, pin mount, a contact pin, a second housing mount, and perimeter gap;

the vaporizing chamber assembly comprises an assembly cap, a heating element, a heating chamber, an insulator, and an assembly seat;

the assembly cap comprises an insulator cover and a second chamber passage;

the heating element comprises a chamber sleeve, a chamber seat, a temperature control assembly, and a flexible connector;

the heating chamber comprises a lip, a lateral wall, a lower plate, a compartment, and an air duct;

the assembly seat comprises air flow channels, a connector emplacement, and an insulator mount;

the sleeve housing, the upper attachment feature, the lower attachment feature, and the vaporizing chamber assembly being centrally aligned to one another;

the vaporizing chamber assembly being enclosed by the upper attachment feature, the lower attachment feature and the sleeve housing;

the vaporizing chamber assembly being positioned between the upper attachment feature and the lower attachment feature;

the upper attachment feature being terminally positioned on the sleeve housing;

the lower attachment feature being terminally positioned on the sleeve housing, opposite the upper attachment feature;

the lower attachment feature being electrically coupled with the vaporizing chamber assembly;

the sleeve housing being in fluid communication with the vaporizing chamber assembly;

the upper attachment feature being partially surrounded by the sleeve housing;

the upper attachment feature being coupled to the first end of the sleeve housing by way of the first housing mount;

the upper attachment feature being coincident with assembly cap opposite the heating chamber and the insulator;

the attachment mount being centrally positioned to the first housing mount;

the first chamber passage centrally traverse the attachment mount;

the plurality of ventilation ports being perimetrically positioned between the first end and the second end;

the plurality of ventilation ports being coincidently aligned with the perimeter gap; and the air duct being in fluid communication with the perimeter gap by way of the air flow channel.

9. The electric vaporizing chamber as claimed in claim 8 comprises:

the lower attachment feature being partially surrounded by the sleeve housing;

the lower attachment feature being coincident with the assembly seat opposite the heating chamber;

the lower attachment feature being coupled to the second end of the sleeve housing by way of the second housing mount;

the perimeter gap being surrounded by the housing sleeve;

the battery mount being centrally positioned to the second housing mount;

the pin mount being recessed within the battery mount;

the pin mount being centrally positioned to the battery mount;

the contact pin being adjustably positioned to the pin mount;

the contact pin being coincidently aligned with the temperature control assembly of the heating element; and the contact pin being in electrical communication with the battery mount by way of the pin mount.

10. The electric vaporizing chamber as claimed in claim 8 comprises:

the second chamber passage being centrally positioned to the insulator cover;

the second chamber passage being aligned with the first chamber passage;

the insulator being secured between the assembly cap and the assembly seat;

the insulator being partially sleeved by the insulator cover;

the insulator being positioned against the insulator mount; and the insulator being perimetrically positioned around the chamber sleeve of the heating element.

11. The electrical vaporizing chamber as claimed in claim 8 comprises:

the lip being securely positioned between the insulator and the assembly cap;

the lateral wall being peripherally surrounded by the chamber sleeve;

the compartment being formed by the lateral wall and the lower plate;

the compartment being operatively aligned with the second chamber passage;

the air duct being positioned on the lower plate opposite the compartment; and the chamber seat being positioned against the lower plate adjacent to the air duct.

12. The electric vaporizing chamber as claimed in claim 8 comprises:

the air flow channel being positioned opposite the connector emplacement across the insulator mount;

the temperature control assembly being positioned opposite the insulator mount;

the temperature control assembly being electrically coupled to the chamber sleeve and the chamber seat by way of the flexible connector; and the flexible connector being coincidently positioned with the connector emplacement.

* * * * *